US008508430B2

(12) United States Patent
Palmer et al.

(10) Patent No.: US 8,508,430 B2
(45) Date of Patent: Aug. 13, 2013

(54) EXTENDABLE RIB REFLECTOR

(75) Inventors: William R. Palmer, Melbourne, FL (US); Bibb B. Allen, Sr., Palm Bay, FL (US); Angelo Bersani, Satellite Beach, FL (US)

(73) Assignee: Harris Corporation, Melbourne, FL (US)

( * ) Notice: Subject to any disclaimer, the term of this patent is extended or adjusted under 35 U.S.C. 154(b) by 294 days.

(21) Appl. No.: 12/697,520

(22) Filed: Feb. 1, 2010

(65) Prior Publication Data

US 2011/0187627 A1 Aug. 4, 2011

(51) Int. Cl.

| | |
|---|---|
| ***H01Q 15/14*** | (2006.01) |
| ***H01Q 1/10*** | (2006.01) |
| ***H01Q 1/08*** | (2006.01) |

(52) U.S. Cl.

USPC ..... 343/915; 343/883; 343/881; 343/912; 343/916

(58) Field of Classification Search

USPC ..... 343/915

See application file for complete search history.

(56) References Cited

U.S. PATENT DOCUMENTS

| | | | | |
|---|---|---|---|---|
| 2,709,220 | A * | 5/1955 | Spector | 52/121 |
| 3,574,447 | A | 4/1971 | Ruble | |
| 4,845,511 | A * | 7/1989 | Grayson et al. | 343/915 |
| 5,146,719 | A * | 9/1992 | Saito et al. | 52/80.1 |
| 5,864,324 | A | 1/1999 | Acker et al. | |
| 6,844,862 | B1 | 1/2005 | Cencich et al. | |
| 7,782,530 | B1 * | 8/2010 | Krumel et al. | 359/399 |
| 2007/0200789 | A1 | 8/2007 | Bassily | |

FOREIGN PATENT DOCUMENTS

| | | |
|---|---|---|
| EP | 0984511 | 3/2000 |
| JP | 4 288705 | 10/1992 |

OTHER PUBLICATIONS

Takano T et al: "Large Deployable Antenna With Cable Constitution for Satellite-Use", Denshi Joho Tsushin Gakkai Ronbunshi. B-2 Transactions of the Institute of Electronics, Information and Communication Engineers. Section J-B-2, Tokyo, JP, vol. J81-B-II, No. 7, Jul. 1, 1998, pp. 673-682, XP009009803, ISSN: 0915-1885.

D'Addario, L R: "Microwave technology innovations in orbiting VLBI", Microwave Symposium Digest, 1992., IEEE MTT-S International Albuquerque, NM, USA Jun. 1-5, 1992, New York, NY, USA,IEEE, US, Jun. 1, 1992, pp. 1375-1378, XP010063032, DOI: D01:10.1109/MWSYM.1992.188262 ISBN: 978-0-7803-0611-0.

Harris Corporation, European Search Report mailed Apr. 12, 2011, European Application No. 11000783.8.

* cited by examiner

*Primary Examiner* — Jacob Y Choi
*Assistant Examiner* — Graham Smith
(74) *Attorney, Agent, or Firm* — Fox Rothschild, LLP; Robert J. Sacco

(57) ABSTRACT

An antenna reflector (100, 700) comprising a centrally located hub (120), inner ribs (108) rotatably secured at a proximal end to the hub, outer ribs (110) extendible from the inner ribs, and a guideline truss structure (132, 160) configured to support a flexible antenna reflector surface (122). The inner ribs are rotatable from a stowed position in which they are generally aligned with a central axis of the hub, to a rotated position in which they extend in a radial direction relative to the central axis. The guideline truss structure is secured to each outer rib using standoff cords attached at intermediate locations along a length of the outer rib between opposing ends (116, 118) thereof. The outer ribs are configured to be linearly displaced respectively along an elongated length of the inner ribs from a proximal position adjacent to the hub, to an extended position distal from the hub.

19 Claims, 13 Drawing Sheets

EXTENDABLE RIB REFLECTOR

BACKGROUND OF THE INVENTION

1. Statement of the Technical Field

The inventive arrangements relate to compact antenna system structures, and more particularly, to a compact deployable antenna reflector structure.

2. Description of the Related Art

Various conventional antenna structures exist that include a reflector for directing energy into a desired pattern. One such conventional antenna structure is a radial rib reflector design comprising a plurality of reflector ribs joined together at a common cylindrical shaped hub. The reflector ribs provide structural support to a flexible antenna reflector surface attached thereto. A plurality of wires or guidelines couple the flexible antenna reflector surface to the reflector ribs. The wires or guidelines define and maintain the shape of the flexible antenna reflector surface. The radial rib reflector is collapsible so that it can be transitioned from a deployed position to a stowed position. In the deployed position, the radial rib reflector has a generally parabolic shape. In the stowed position, the reflector ribs are folded up against each other. As a result, the antenna reflector has a stowed height approximately equal to the reflector's radius.

Another conventional antenna structure is a folding rib reflector having a similar design to the radial rib reflector design described above. However, the reflector ribs include a first rib shaft and second rib shaft joined together by a common joint. In the stowed position, the first rib shafts are folded up against the second rib shafts. As such, the antenna reflector has a stowed height that is less than the stowed height of the radial rib reflector design. However, the stowed diameter of the folding rib reflector is larger than the stowed diameter of the radial rib reflector design.

SUMMARY OF THE INVENTION

Embodiments of the present invention concern antenna reflectors and methods of deploying the antenna reflectors. Each of the antenna reflectors includes extendable ribs coupled to a centrally located hub. Each of the extendable ribs includes an inner rib rotatably coupled to the hub. Each of the extendable ribs also includes an outer rib slidingly coupled to a respective inner rib. The outer rib can be, but is not limited to, a hollow tube or a collar.

During deployment of an antenna reflector, the extendable ribs are rotated from a stowed position in which the extendable ribs are generally aligned with a central axis of the hub, to a rotated position in which the extendable ribs extend in radial directions relative to the central axis. Each of the outer ribs is linearly displaced on the inner rib from a proximal position adjacent to the hub to an extended position distal from the hub. A flexible antenna reflector surface is supported on a guideline truss structure that is under tension when each of the outer ribs is in its extended position. The guideline truss structure includes cords attached at intermediate locations along a length of each outer rib between opposing ends thereof. Each of the outer ribs is secured in its extended position with a locking mechanism or a mechanism configured to eliminate a reverse motion of said extended outer rib. During use of the antenna reflector, a shaped reflective surface is illuminated using an antenna feed supportably located in opposed relation with respect to the curved reflective surface.

The antenna reflector is re-stored to its stowed position by unsecuring the outer ribs, and linearly displacing each of the outer ribs on a respective inner rib from its extended position to its proximal position adjacent to the hub. Each of the outer ribs is linearly displaced on the respective inner rib by transforming a rotation induced by at least one motor of the hub to linear motion. The rotation is transformed to a linear motion using at least one mechanical component. The mechanical component can be selected from the group comprising a worm gear, a pinion gear, a spur gear, a pulley with a driving belt and a drive shaft.

According to an aspect of the present invention, one or more solar panels are concurrently extended with the rotating and linearly displacing outer ribs. The solar panels can be used to charge a battery. The battery can supply electrical power to the antenna system inclusive of the motor facilitating the deployment of the antenna reflector.

BRIEF DESCRIPTION OF THE DRAWINGS

Embodiments will be described with reference to the following drawing figures, in which like numerals represent like items throughout the figures, and in which.

DETAILED DESCRIPTION

The invention described and claimed herein is not to be limited in scope by the preferred embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

The word "exemplary" is used herein to mean serving as an example, instance or illustration. Any aspect or design described herein as "exemplary" is not necessarily to be construed as preferred or advantageous over other aspects or designs. Rather, use of the word exemplary is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is if, X employs A; X employs B; or X employs both A and B, then "X employs A or B" is satisfied under any of the foregoing instances.

The extendable rib reflector antenna described herein offers several advantages. For example, it (a) provides a simpler architecture than conventional folding rib reflector designs, (b) eliminates the need for a hub tower, (c) allows a feed tower to be provided on a surface side of a reflector, (d) has reduced guideline lengths, and (e) ensures that there is no overstretch of the flexible antenna reflector surface and guidelines.

An exemplary extendable rib reflector antenna 100 will now be described in relation to FIGS. 1-6, 9 and 10. The extendable rib reflector antenna 100 can be mounted on a support structure, such as a space borne vehicle (e.g., a spacecraft). The objective of the extendable rib reflector antenna 100 is to: (a) maintain a deployed surface accuracy; (b) provide a reflector with a desirably shaped aperture; (c) provide larger deployed aperture with an overall mechanical structure comprising a smaller stowed volume; (d) provide controlled synchronous/continuous deployment of the reflector; and/or (e) provide methods to stow the flexible reflective surface as shown in FIGS. 8A-8E.

Figure 1:
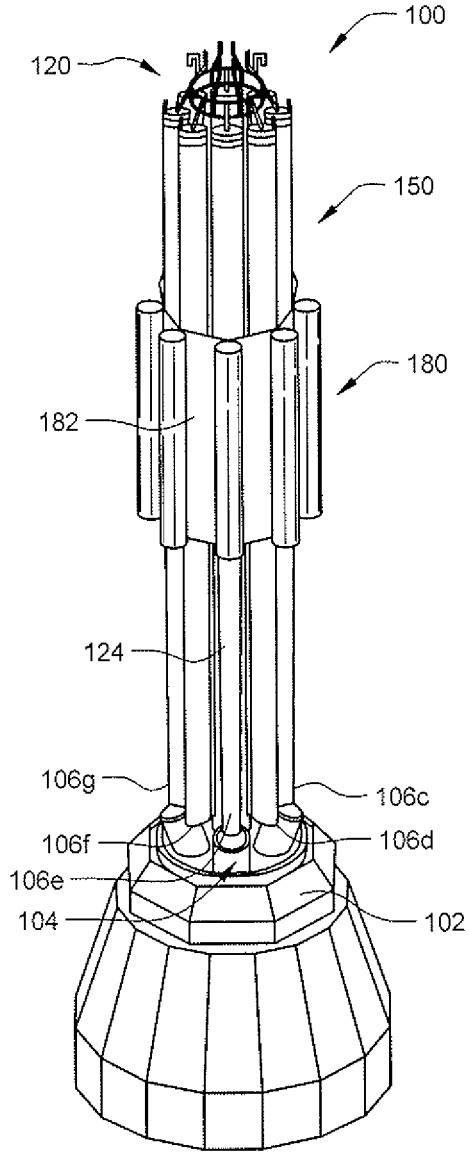
FIG. 1 is a perspective view of an exemplary extendable rib reflector in a stowed position.
Figure 2:
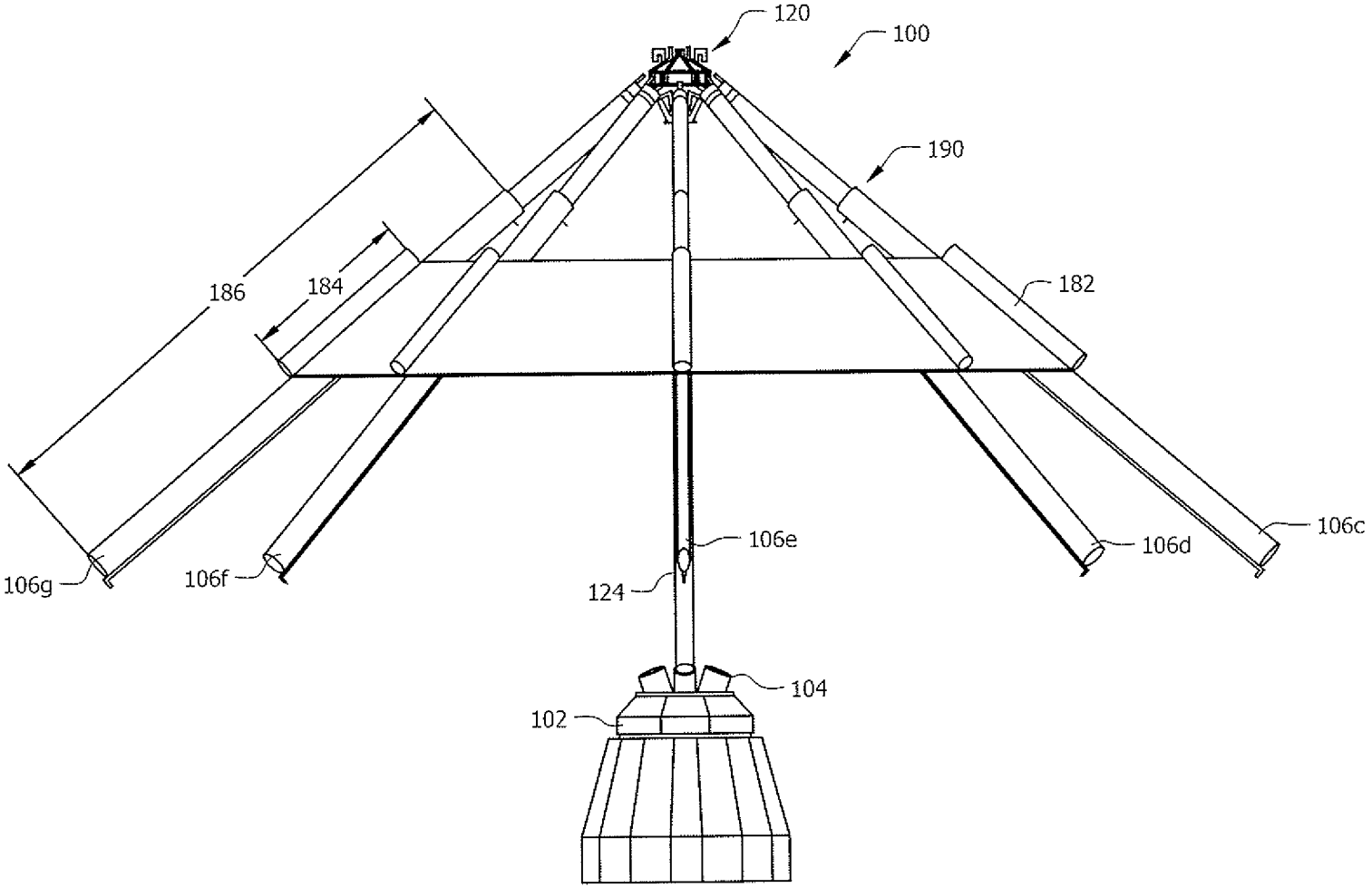
FIG. 2 is a side view of an exemplary extendable rib reflector having reflector ribs at least partially rotated away from each other.
Figure 3:
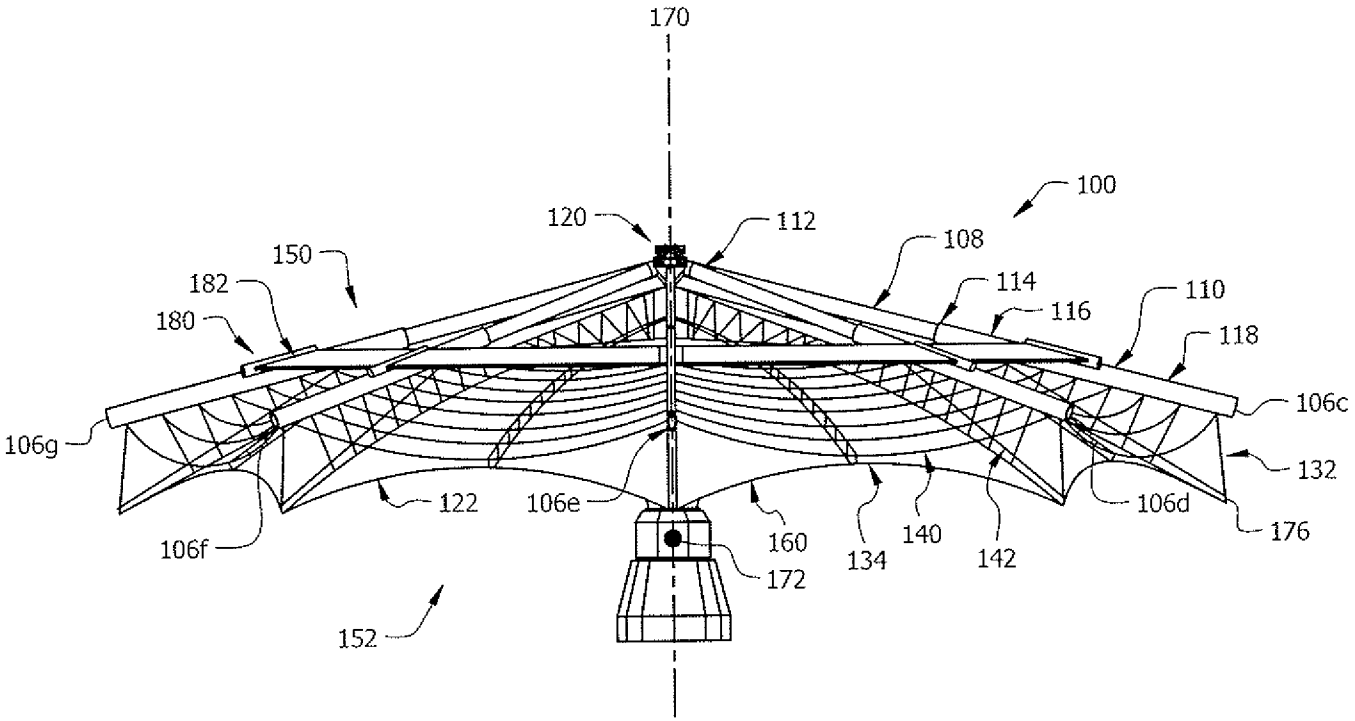
FIG. 3 is a perspective side view of an exemplary extendable rib reflector in a fully extended position.
Figure 9:
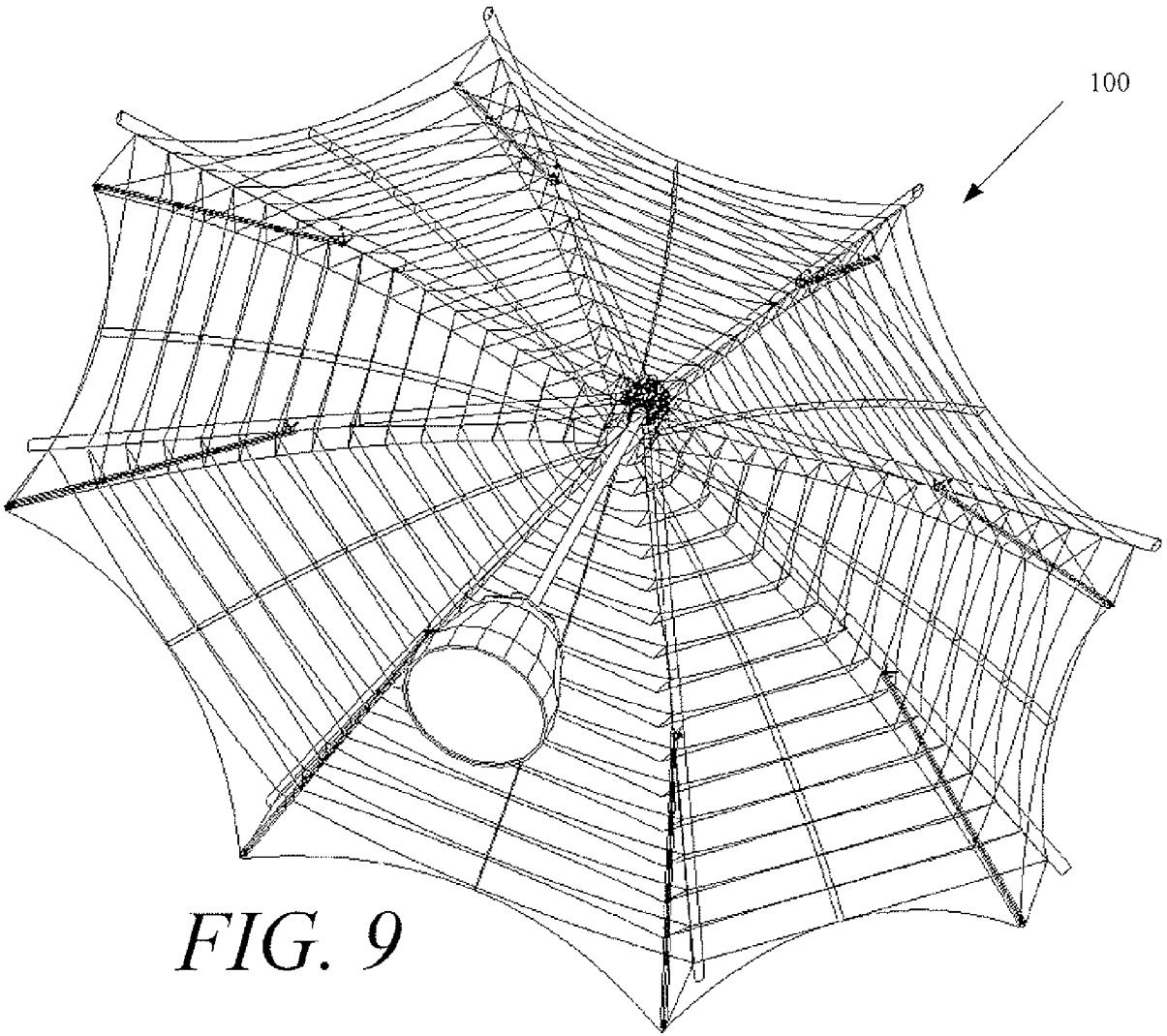
FIG. 9 is a front perspective view of an exemplary extendable rib reflector antenna that is useful for understanding the present invention.
Figure 10:
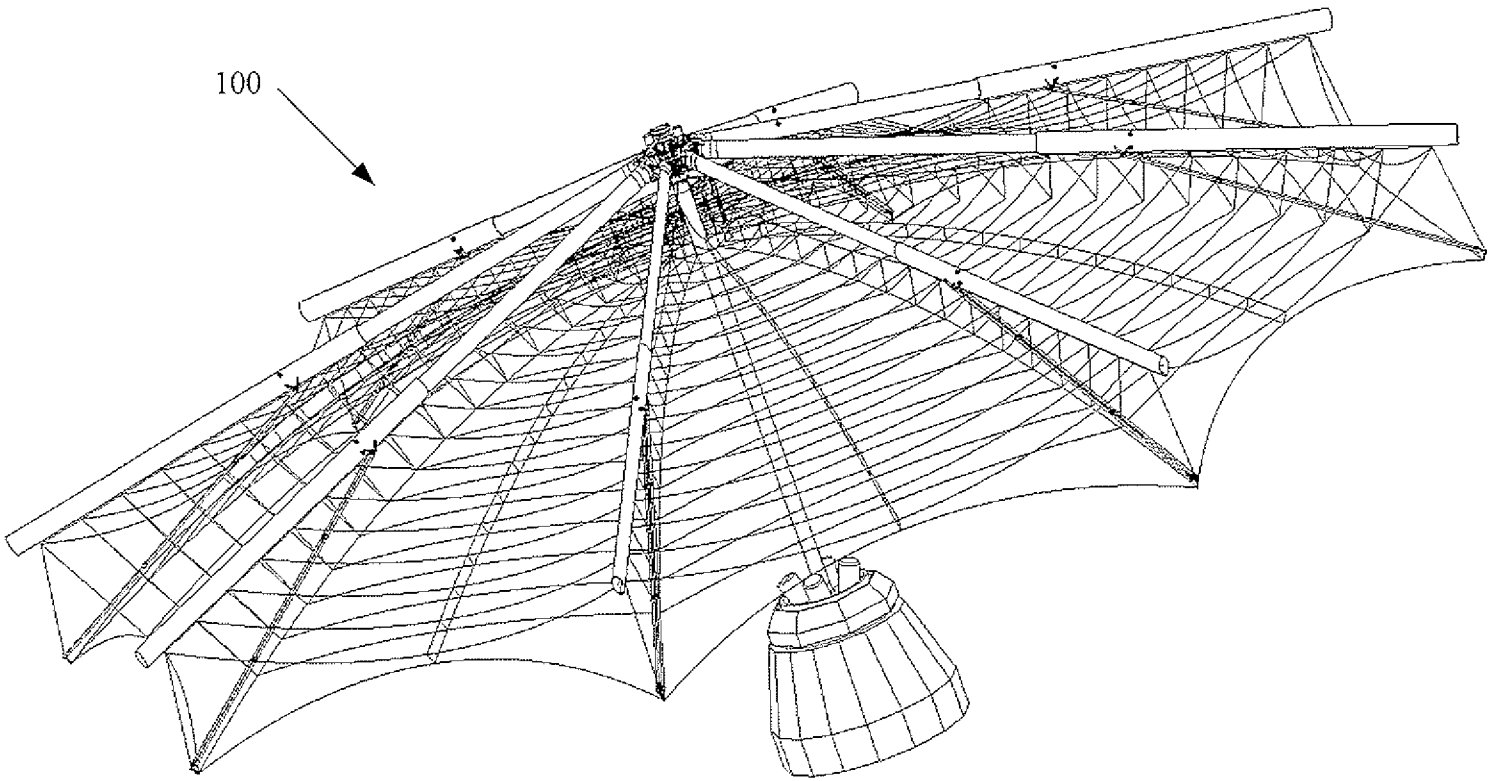
FIG. 10 is a back perspective view of an exemplary extendable rib reflector antenna that is useful for understanding the present invention.

Referring now to FIG. 1, there is provided a perspective view of the extendable rib reflector antenna 100 in a stowed position. In FIG. 2, there is provided a side view of the extendable rib reflector antenna 100 having a plurality of reflector ribs 106*a*, 106*b*, 106*c*, 106*d*, 106*e*, 106*f*, 106*g* at least partially rotated away from each other. In FIG. 3, there is provided a perspective side view of the extendable rib reflector antenna 100 in a fully extended position. In FIG. 9 there is provided a front perspective view of the extendable rib reflector antenna 100. In FIG. 10 there is provided a back perspective view of the extendable rib reflector antenna 100. In FIGS. 1-2, an antenna reflector surface 122 is not shown for purposes of simplicity. However, it should be understood that the antenna reflector surface 122 is at least partially folded when the extendable rib reflector antenna 100 is in its non-extended position shown in FIG. 1.

As shown in FIGS. 1-3, the extendable rib reflector antenna 100 has an appearance that is similar to a conventional radial rib reflector. However, the extendable rib reflector antenna 100 stows more compactly, relative to deployed aperture area, as compared to conventional radial rib reflector antennas. In general, the extendable rib reflector antenna 100 includes a centrally located hub 120, an antenna feed structure 102 and a reflector structure 150. The hub 120 includes at least one drive component for mechanically controlling the deployment of the extendable rib reflector antenna 100. The drive component can include, but is not limited to, rib fittings, drive units, gears, drive shafts, drive belts, ball screws and push rods.

The antenna feed structure 102 generally comprises an antenna feed 104 configured to convey radio waves between a transceiver and the antenna reflector surface 122. Antenna feed structures 102, 104 are well known to those having ordinary skill in the art, and therefore will not be described in detail herein. However, it should be understood that the antenna feed method can include any suitable antenna feed structure. For example, the antenna feed structure 102, 104 may include an antenna horn, an orthomode transducer, a frequency diplexer, a waveguide, waveguide switches, a rotary joint, active patch elements and electronically steerable feed.

The antenna feed structure 102 is provided on a reflective surface side 152 of the extendable rib reflector antenna 100 as shown in FIG. 3. More particularly, the antenna feed 104 is located above the reflective side of the antenna reflector surface 122 by means of a post 124. The post 124 extends along a central longitudinal axis 170 of the extendable rib reflector antenna 100. The post 124 is coupled to the hub 120 via any suitable mechanical connectors (e.g., bolts, screws or a weld). The antenna feed 104 is generally positioned at the focus 172 of the curved antenna reflector surface 122, but the invention is not limited in this regard. During transmit operation of the extendable rib reflector antenna 100, the curved antenna reflector surface 122 is illuminated by an incident radio frequency (RF) signal from the antenna feed 104. At least a portion of the RF signal is reflected by the antenna reflector surface 122 to yield a desired reflected RF energy distribution. In a receive mode, incident RF energy is focused by the reflector and directed toward the antenna feed 104.

The reflector structure 150 generally has a circular, parabolic shape when the extendable rib reflector antenna 100 is in its fully extended position as shown in FIG. 3. The reflector structure 150 includes the foldable antenna reflector surface 122, a plurality of extendable ribs 106*a*, 106*b*, 106*c*, 106*d*, 106*e*, 106*f*, 106*g* and a guideline truss structure 132, 160.

The antenna reflector surface 122 is formed from any material that is suitable to serve as an antenna's reflective surface. Such materials include, but are not limited to, reflective wire woven mesh materials similar to light weight woven fabrics. In its fully extended position shown in FIG. 3, the antenna reflector surface 122 has a size and shape selected for directing RF energy into a desired pattern. For example, the antenna reflector surface 122 has a scalloped cup shape with concave peripheral edge portions 134. Embodiments of the present invention are not limited in this regard.

The antenna reflector surface 122 extends at least partially around the central longitudinal axis 170 of the extendable rib reflector antenna 100. As such, the antenna reflector surface 122 is defined by a curve symmetrically rotated about the central longitudinal axis 170 of the extendable rib reflector antenna 100. Although the curve of the antenna reflector surface 122 shown in FIG. 3 has a focus on the central longitudinal axis 170, embodiments of the present invention are not limited in this regard. For example, the curve of the antenna reflector surface 122 may alternatively be selected to have a focus laterally displaced from the central longitudinal axis 170 of the extendable rib reflector antenna 100. In this scenario, the antenna feed 104 may also be laterally displaced from the central longitudinal axis 170 of the extendable rib reflector 100. This creates an offset antenna configuration where the main beam of the antenna is not blocked by the antenna feed structure 102, 104.

The extendable ribs 106*a*, 106*b*, 106*c*, 106*d*, 106*e*, 106*f*, 106*g* are rotatably coupled to the hub 120. As such, the extendable ribs 106*a*, 106*b*, 106*c*, 106*d*, 106*e*, 106*f*, 106*g* can be rotated from the stowed position shown in FIG. 1 to a fully extended position shown in FIG. 3. In the stowed position, the extendable ribs 106*a*, 106*b*, 106*c*, 106*d*, 106*e*, 106*f*, 106*g* are generally aligned with the central longitudinal axis 170 of the extendable rib reflector antenna 100. The extendable ribs 106*a*, 106*b*, 106*c*, 106*d*, 106*e*, 106*f*, 106*g* are rotatable so that they can extend radially away from the central longitudinal axis 170 of the extendable rib reflector antenna 100 when in the extended position.

Each extendable rib 106*a*, 106*b*, 106*c*, 106*d*, 106*e*, 106*f*, 106*g* includes an inner rib 108 and a outer rib 110 movably disposed on the inner rib 108. In this regard, it should be understood that the inner rib 108 has at least a proximal end 112 attached to the hub 120. The outer rib 110 is disposed on the inner rib 108 so as to allow the outer rib 110 to be linearly displaced on the inner rib 108. The linear displacement of the outer rib 110 is achieved by transforming a rotation induced by at least one motor of the hub 120 to linear motion. The rotation can be transformed to a linear motion using at least one mechanical system. The mechanical system can include, but is not limited to, a worm gear, a pinion gear, a spur gear, a pulley and a drive shaft. At least a portion of the mechanical system can be disposed in the inner and/or outer ribs 108, 110. Still, those skilled in the art will appreciated that linear displacement of the outer rib can be accomplished by any other suitable means.

The linear displacement of the outer rib 110 allows the extendable rib 106*a*, 106*b*, 106*c*, 106*d*, 106*e*, 106*f*, 106*g* to be expanded from a stowed configuration shown in FIG. 1 to a fully extended configuration shown in FIG. 3. In the stowed configuration, a proximal end 116 of the outer rib 110 is located at about the proximal end 112 of the inner rib 108. In the fully extended configuration, the proximal end 116 of the outer rib 110 is located at a distal end 114 of the inner rib 108. Exemplary structures of the extendable ribs 106*a*, 106*b*, 106*c*, 106*d*, 106*e*, 106*f*, 106*g* will be described in more detail below in relation to FIGS. 4-6.

Each of the extendable ribs 106*a*, 106*b*, 106*c*, 106*d*, 106*e*, 106*f*, 106*g* includes a locking mechanism (not shown in FIGS. 1-3) or other mechanism (e.g., a mechanical stop or a worm drive) configured to eliminate a reverse motion of said extended outer rib (not shown in FIGS. 1-3) to selectively secure the outer rib 110 in the extended position shown in FIG. 3. Locking mechanisms are well known to those having ordinary skill in the art, and therefore will not be described herein. However, it should be understood that any suitable locking mechanism can be used without limitation. For example, in one embodiment, each of the extendable ribs 106*a*, 106*b*, 106*c*, 106*d*, 106*e*, 106*f*, 106*g* includes a latch and an adjustable stop that collectively lock the outer rib 110 in its extended position. Embodiments of the present invention are not limited in this regard. Latches are extensively used as a redundant lock. In cases where right angle drives are used, latches are not required.

As will be apparent to those having ordinary skill in the art, the extensibility of the ribs 106*a*, 106*b*, 106*c*, 106*d*, 106*e*, 106*f*, 106*g* allows the stowed height of the extendable rib reflector antenna 100 to be reduced as compared to conventional radial rib reflector designs. The extensibility of the ribs 106*a*, 106*b*, 106*c*, 106*d*, 106*e*, 106*f*, 106*g* also reduces the stowed diameter of the extendable rib reflector antenna 100 as compared to the conventional folding rib reflector designs. The extensibility of the ribs 106*a*, 106*b*, 106*c*, 106*d*, 106*e*, 106*f*, 106*g* also ensures that the antenna reflector surface 122 will not be over stretched during deployment of the extendable rib reflector antenna 100.

As shown in FIG. 3, the antenna reflector surface 122 is fastened to the extendable ribs 106*a*, 106*b*, 106*c*, 106*d*, 106*e*, 106*f* and 106*g* via the guideline truss structure 132. The guideline truss structure 132 supports the antenna reflector surface 122 creating a parabolic shape. The antenna reflector surface 122 is dominantly shaped by the guideline truss structure 132.

The guideline truss structure 132 defines and maintains the shape of the extendable rib reflector antenna 100 when it is in use. In this regard, the guideline truss structures 132 and 160 include a plurality of interconnected cords (or thread like strings) 176. The cords 176 are positioned between the antenna reflector surface 122 and the extendable ribs 106*a*, 106*b*, 106*c*, 106*d*, 106*e*, 106*f*, 106*g* so as to provide structural stiffness to the antenna reflector surface 122 when the extendable rib reflector antenna 100 is in-use. When the extendable rib reflector antenna 100 is in its fully deployed configuration, the guideline truss structures 132 and 160 are stable structures under tension. The tension is achieved by applying pulling forces to the cords ends by means of compression member 142 which is mechanically attached to the outer rib 110 so as to take up slack in the cords. The pulling forces are applied to the cords 176 at least partially by the extendable ribs 106*a*, 106*b*, 106*c*, 106*d*, 106*e*, 106*f*, 106*g*. An exemplary configuration of the cords 176 will be described below in relation to FIG. 7.

As shown in FIGS. 1-3, the extendable rib reflector antenna 100 further includes a solar energy collector 180. The solar energy collector 180 is generally configured to convert solar energy to electricity. Electricity is advantageously used to charge a battery (not shown in FIGS. 1-3) of a vehicle (e.g., a spacecraft). The battery may be used to power one or more motors of the hub 120 that facilitate the deployment of the extendable rib reflector antenna 100. The batter may also be used to supply electric power for spacecraft operations.

The solar energy collectors 180 are photovoltaic type solar panels which are well known to those having ordinary skill in the art, and therefore will not be described in detail herein. However, it should be understood that the solar panel 180 can include, but is not limited to, a thin film rolled solar panel and/or a fan fold solar panel, adopting folding methods known to persons having ordinary skill in the art. The solar panel 180 is tensioned into a stable configuration in its deployed state as shown in FIG. 3.

The solar panel 180 is coupled to the outer ribs 110 of the extendable ribs 106*a*, 106*b*, 106*c*, 106*d*, 106*e*, 106*f*, 106*g* via any suitable mechanical connectors 182. Such mechanical connectors include, but are not limited to, screws, rivets, clips, springs and a variety of adhesives (e.g., glue). Springs can advantageously be used at the interfaces of the solar panel and outer ribs 110 to ensure that appropriate tension loads are placed on the solar panel 180 without placing undue loads in the supporting extendable ribs 106*a*, 106*b*, 106*c*, 106*d*, 106*e*, 106*f*, 106*g*.

Although the solar panel 180 is shown in FIGS. 1-3 to have a width 184 that is about ¼ the length 186 of the outer ribs 110, embodiments of the present invention are not limited in this regard. For example, the width 184 of the solar panel 180 can be selected in accordance with a particular solar panel application. As such, the width 184 of the solar panel 180 can be less than or greater than ¼ the length 186 of the outer ribs 110. In one embodiment, the width 184 of the solar panel 180 is substantially equal to the length 186 of the outer ribs 110. In addition, the position of solar panel 180 along the length 186 may be varied depending on the embodiment of the design.

Figure 4:
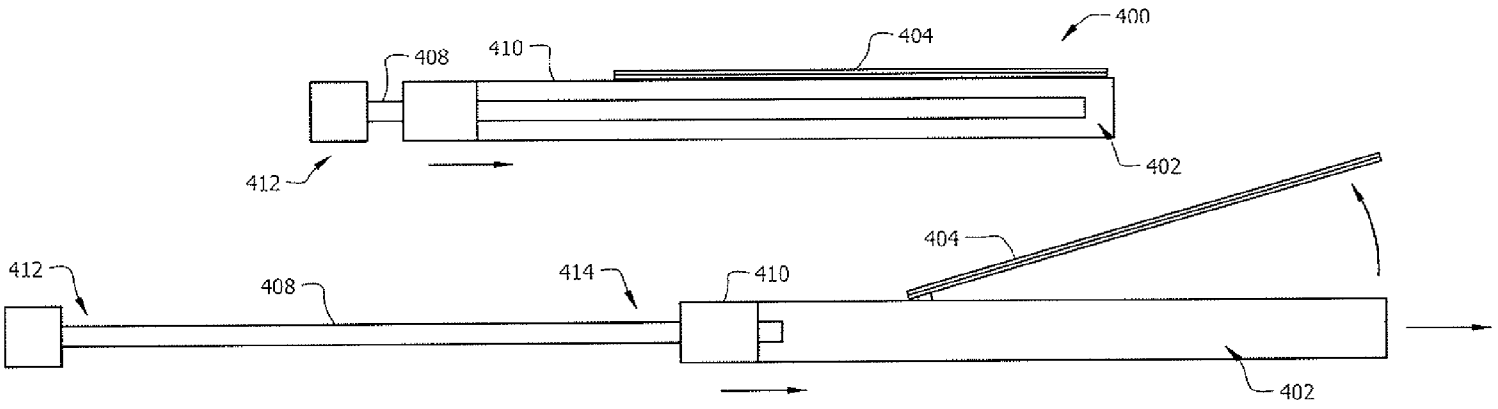
FIG. 4 is a schematic illustration of an exemplary extendable rib of the extendable rib reflector of FIG. 1.
Figure 5:
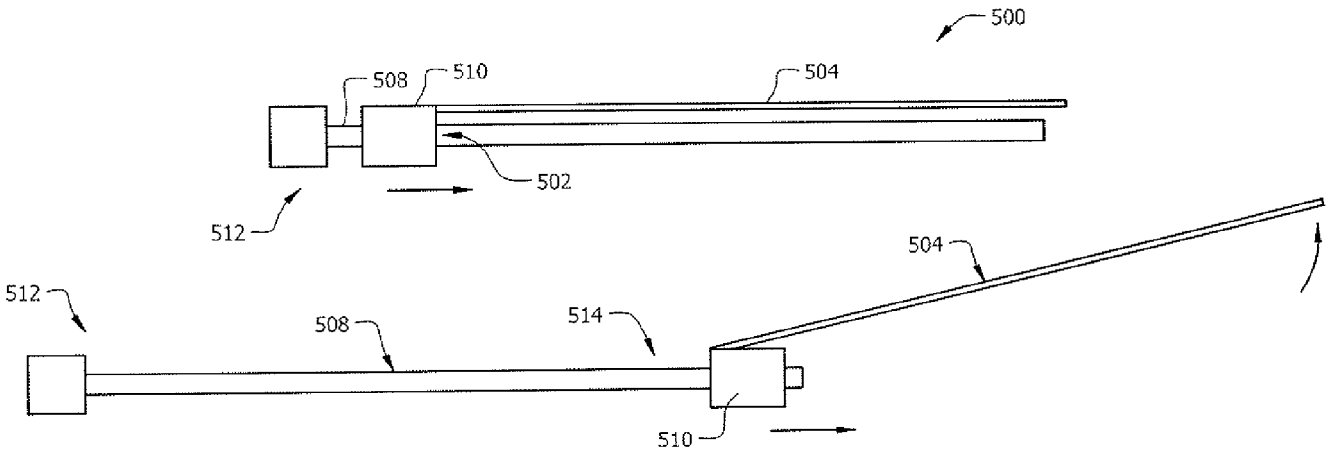
FIG. 5 is a schematic illustration of another exemplary extendable rib that is useful for understanding the present invention.
Figure 6:
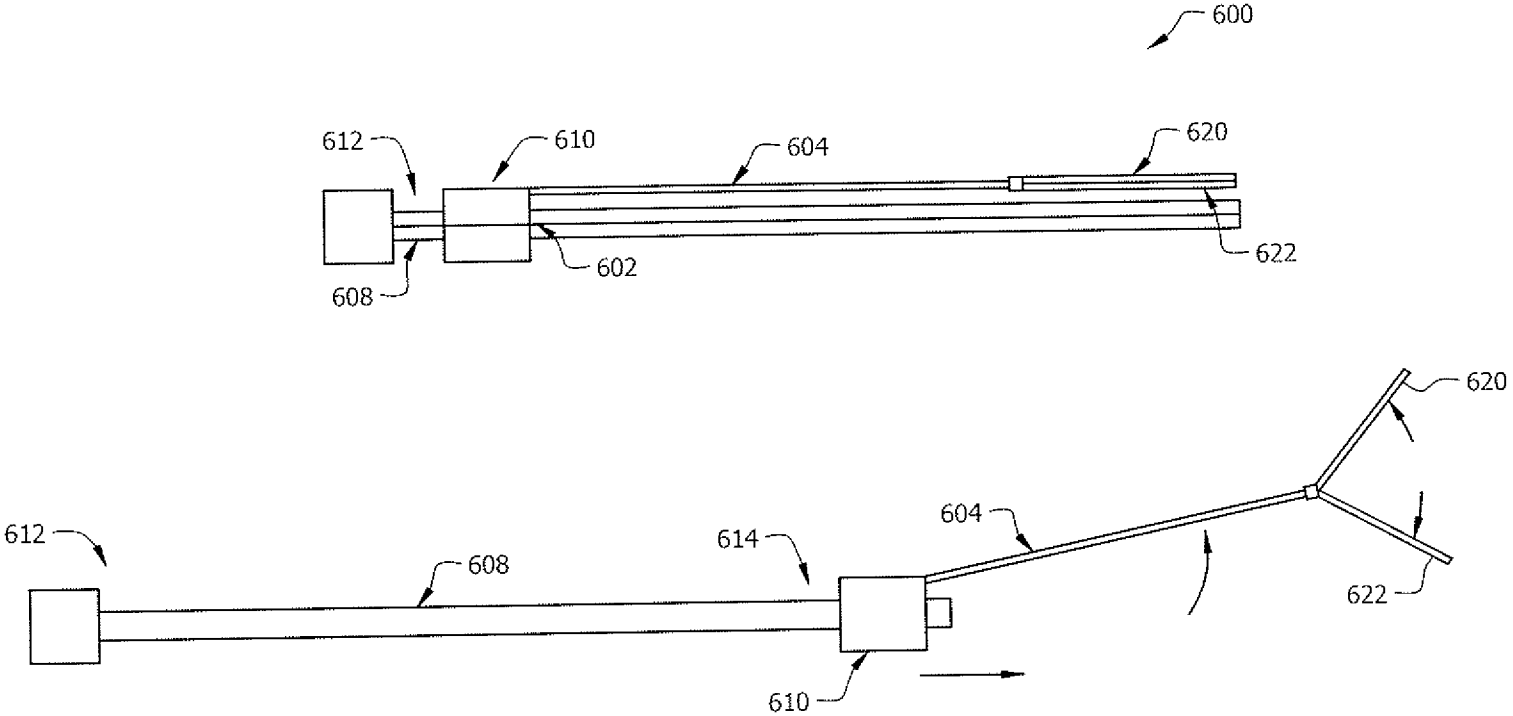
FIG. 6 is a schematic illustration of yet another exemplary extendable rib that is useful for understanding the present invention.

Referring now to FIGS. 4-6, there are provided schematic illustrations of exemplary extendable ribs 400, 500, 600. The extendable ribs 106*a*, 106*b*, 106*c*, 106*d*, 106*e*, 106*f*, 106*g* can be configured in a manner similar to any of the exemplary extendable ribs 400, 500, 600. Still, it should be appreciated that the invention is not limited in this regard and alternative arrangements are also possible within the scope of the invention.

As shown in FIGS. 4-6, each of the extendable ribs 400, 500, 600 includes an inner rib 408, 508, 608 and an outer rib 410, 510, 610. At least one compression member 404, 504, 604, 620, 622 is used to provide tension to the guideline truss structure. Compression members are well known to those having ordinary skill in the art, and therefore will not be described herein. However, it should be understood that a compression member 404, 504, 604 is advantageously coupled to an inner rib 408, 508, 608 by means of a rotatable member. Also, one or more additional compression members 620, 622 can be rotatably coupled to the compression member 604. The compression members 404, 504, 604, 620, 622 facilitate the application of pulling forces on the interconnected cords or wires (e.g., the cords or wires 176 of FIGS. 1-3) of a guideline truss structure 132 and provides support for the reflector surface.

The inner rib 408, 508, 608 is a structural member with a proximal end 412, 512, 612 and a distal end 414, 514, 614. The outer rib 410, 510, 610 is preferably arranged to move linearly along the length of the inner rib 408, 508, 608. To permit such motion, the outer rib 410, 510, 610 can be a hollow tube 410 as shown in FIG. 4 or a collar 510, 610 as shown in FIGS. 5-6. The outer rib/outer collar 410, 510, 610 is configured mechanically as to not be rotatable around inner rib 408, 508, 608 by means of the inner rib shape or by means of a keying feature. Still, the invention is not limited in this regard. Other linear guide arrangements are possible, provided that a plurality of attachment points can be provided along a length of the outer rib 410, 510, 610 and/or compression members 404, 504, 604, without interfering with the linear motion of the outer rib. This arrangement is thus distinguishable from telescoping systems where the outer rub telescopes from within the inner rib. As the outer rib/outer collar 410, 510, 610 is linearly displaced on the inner rib 408, 508, 608, the compression member 404, 504, 604 rotates away from the inner rib 408, 508, 608 as shown in FIGS. 4-6. Also, the additional compression members 620, 622 rotate away from each other as shown in FIG. 6.

According to another embodiment of the invention, the extendable ribs 106*a*, 106*b*, 106*c*, 106*d*, 106*e*, 106*f*, 106*g* can include cuffs instead of the collars 510, 610 shown in FIGS. 5-6. As used herein, the term cuff refers to any structure capable of being guided along an exterior surface of inner rib 408, 508, 608. For example, a cuff could include a structure similar to collar 502, but which only extends partially around an exterior of inner rib 408. Also, the extendable ribs 106*a*, 106*b*, 106*c*, 106*d*, 106*e*, 106*f*, 106*g* can include a guide structure for linearly displacing linearly displacing the outer ribs 410, 510, 610 respectively along an elongated length of the inner ribs 408, 508, 608 from a proximal position adjacent to a centrally located hub 120, to an extended position distal from a centrally located hub 120. Such guide structures include, but are not limited to, a pulley track system or any other suitable track system.

Figure 7:
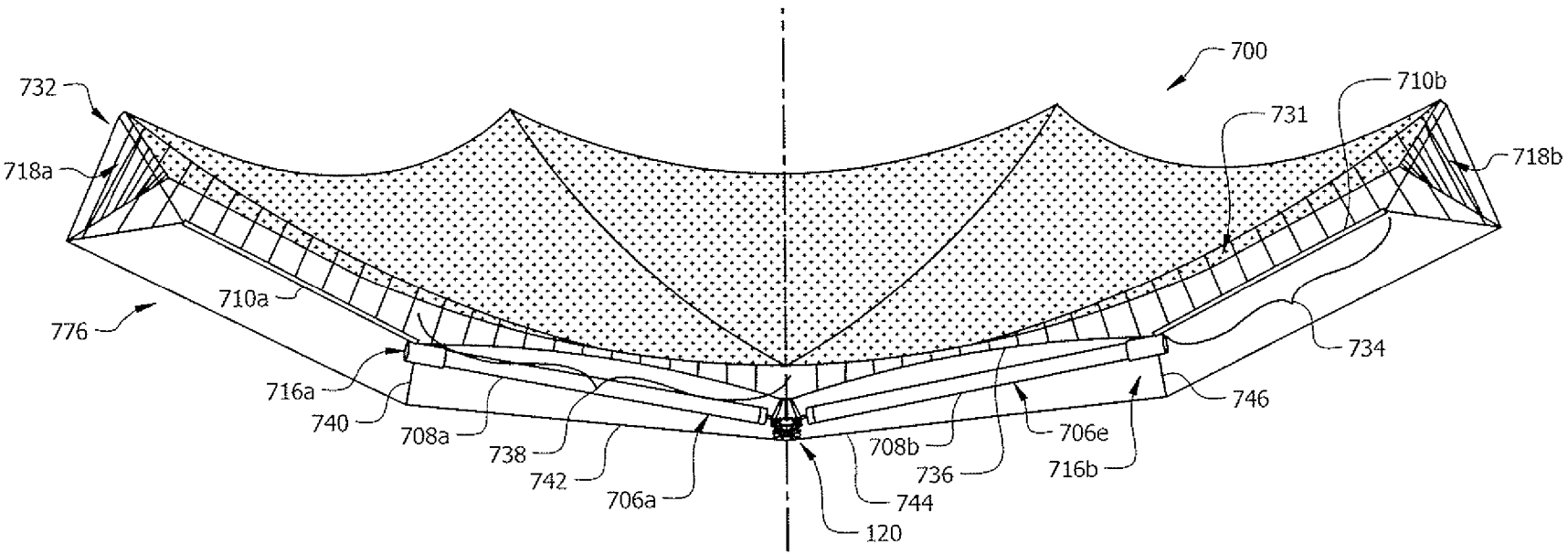
FIG. 7 is a cross sectional view of an exemplary extendable rib reflector that is useful for understanding a guideline truss structure.

A cross sectional view of another exemplary extendable rib reflector 700 is provided in FIG. 7 that is useful for understanding a guideline truss structure. The extendable rib reflector 700 is substantially similar to the extendable rib reflector antenna 100 described above in relation to FIGS. 1-3. Notably, the feed 130 has been removed from FIG. 7 for purposes of clarity. Also, the extendable rib reflector 700 has extendable ribs 600 shown in FIG. 6 as opposed to the extendable ribs 400, 500 shown in FIGS. 4-5. Embodiments of the present invention are not limited in this regard.

As shown in FIG. 7, the interconnected cords 776 of the guideline truss structure 732 include a plurality of arch cords 731, a plurality of sets of first standoff cords 734, a plurality of inner catenaries 736, a plurality of sets of second standoff cords 738, rear struts 740, 746 and rear structural cords 742, 744. Each of the arch cords 731 is attached from a distal end 718*a* of a first outer rib 710*a* of a first extendable rib 706*a* to a distal end 718*b* of a second outer rib 710*b* of a second extendable rib 706*e*. Each set of first standoff cords 734 is attached between a respective arch cord 731 and the outer rib 710*b* of a respective extendable rib 706*a*, 706*e*. Each of the inner catenaries 736 is attached from the hub 120 to a proximal end 716*a*, 716*b* of the outer rib 710*a*, 710*b* of a respective extendable rib 706*a*, 706*e*. Each sets of second standoff cords 738 is attached between respective arch cords 731 and inner catenaries 736. Each of the rear structural cords 742, 744 is attached from the hub 120 to a distal end 718*a*, 718*b* of the outer rib 710*a*, 710*b* of a respective extendable rib 706*a*, 706*e*. Each of the rear struts 740, 746 is attached between the respective rear structural cords 742, 744 and the proximal end 716*a*, 716*b* of the outer rib 710*a*, 710*b* of a respective extendable rib 706*a*, 706*e*. The rear struts 740, 746 and rear structural cords 742, 744 are provided to relieve the load from the extendable ribs 706*a*, 706*e*.

Referring now to FIGS. 8A-8F, there is provided a deployment sequence for deploying the extendable rib reflector 700 of FIG. 7. In order to carryout the deployment sequence, the hub 120 employs pivotable rib fittings, drive units (e.g., motors), gears, drive shafts, ballscrews, push rods and/or mechanical stops for mechanically controlling the deployment of the extendable rib reflector 700.

The deployment sequence will now be described in relation to FIGS. 8A-8F. It should be noted that FIGS. 8A-8F show the deployment of two (2) reflector ribs 706*a*, 706*e* only. The deployment of the other reflector ribs of the extendable rib reflector 700 is the same as or substantially similar to the deployment of reflector ribs 706*a*, 706*e*. As such, the description provided below in relation to the deployment of reflector ribs 706*a*, 706*e* is sufficient for understanding the deployment of the other reflector ribs of the extendable rib reflector 700. It should be noted that the feed 130 and the cords 731, 734, 736, 738, 740, 742, 744, 746 of the guideline truss structure 732 have been removed from some views of FIGS. 8A-8F for purposes of clarity and ease of explanation.

Figure 8A:
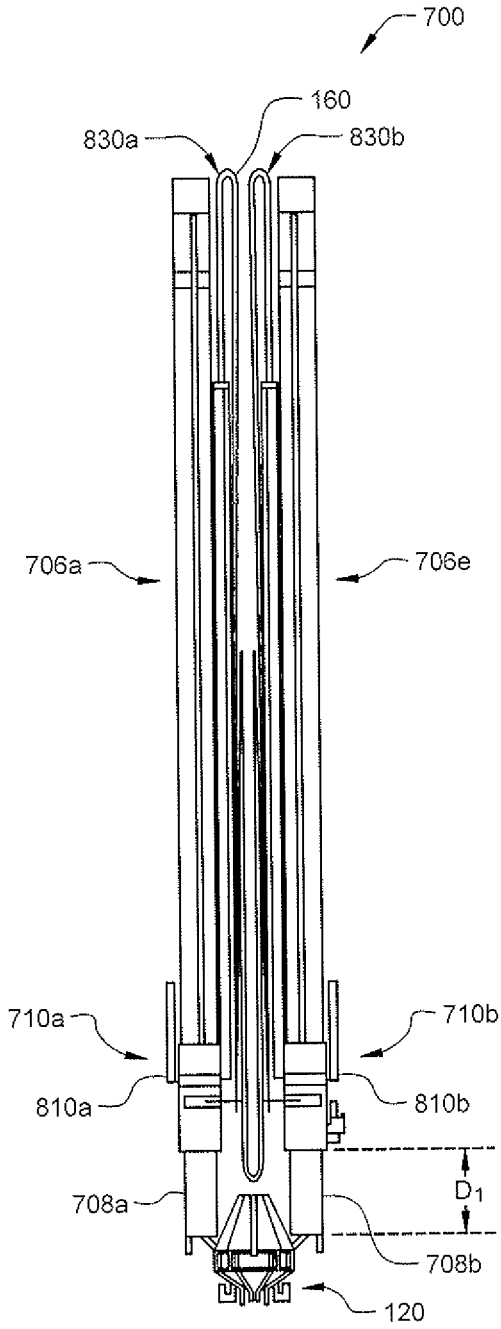
FIGS. 8A-8E collectively illustrate a deployment sequence for the extendable rib reflector shown in FIG. 7.

Referring now to FIG. 8A, the reflector ribs 706*a*, 706*e* are in their stowed position. In the stowed position, the reflector ribs 706*a*, 706*e* are in a substantially parallel arrangement with respect to each other and generally aligned with a central axis defined by hub 120. Notably, each of the outer ribs 710*a*, 710*b* of the reflector ribs 706*a*, 706*e* include a collar 810*a*, 810*b* and compression members 830*a*, 830*b* coupled to the collar 810*a*, 810*b*. The collar 810*a*, 810*b* is disposed on a respective inner rib 708*a*, 708*b* at a certain distance $D_1$ from the common hub 120.

Figure 8B:
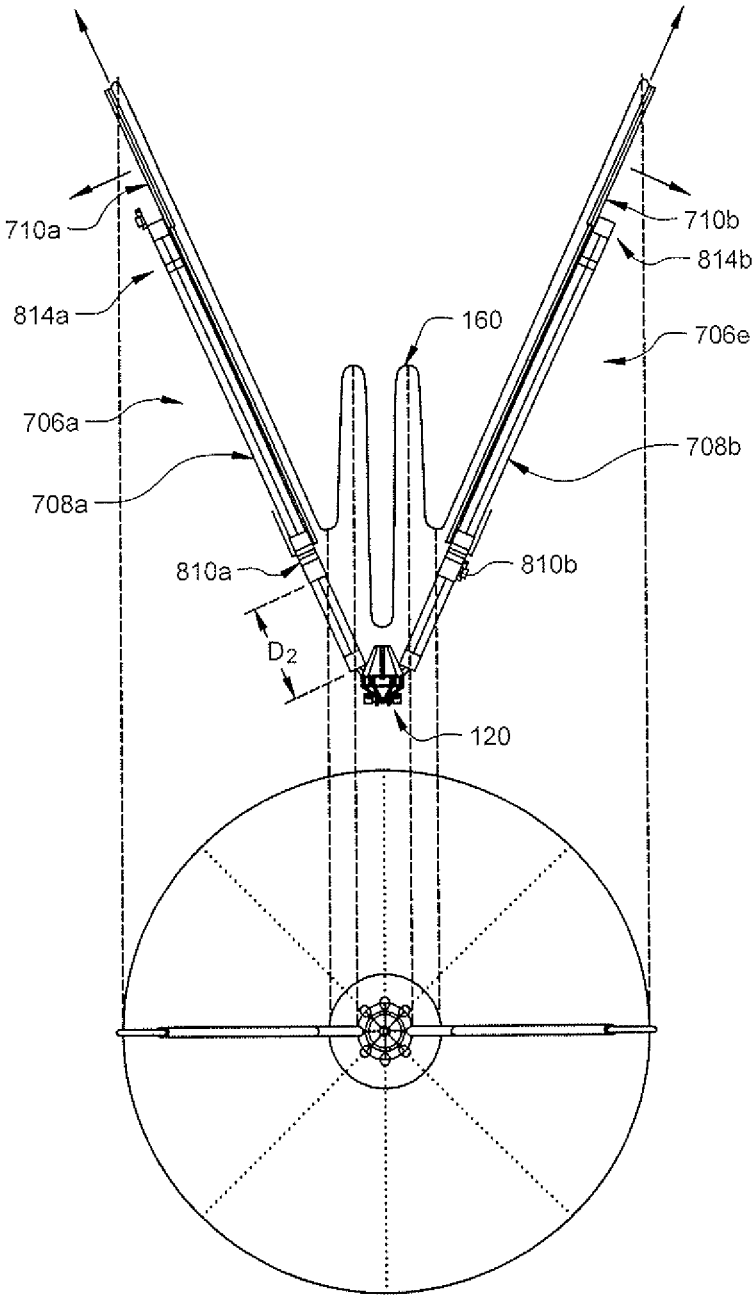
Figure 8C:
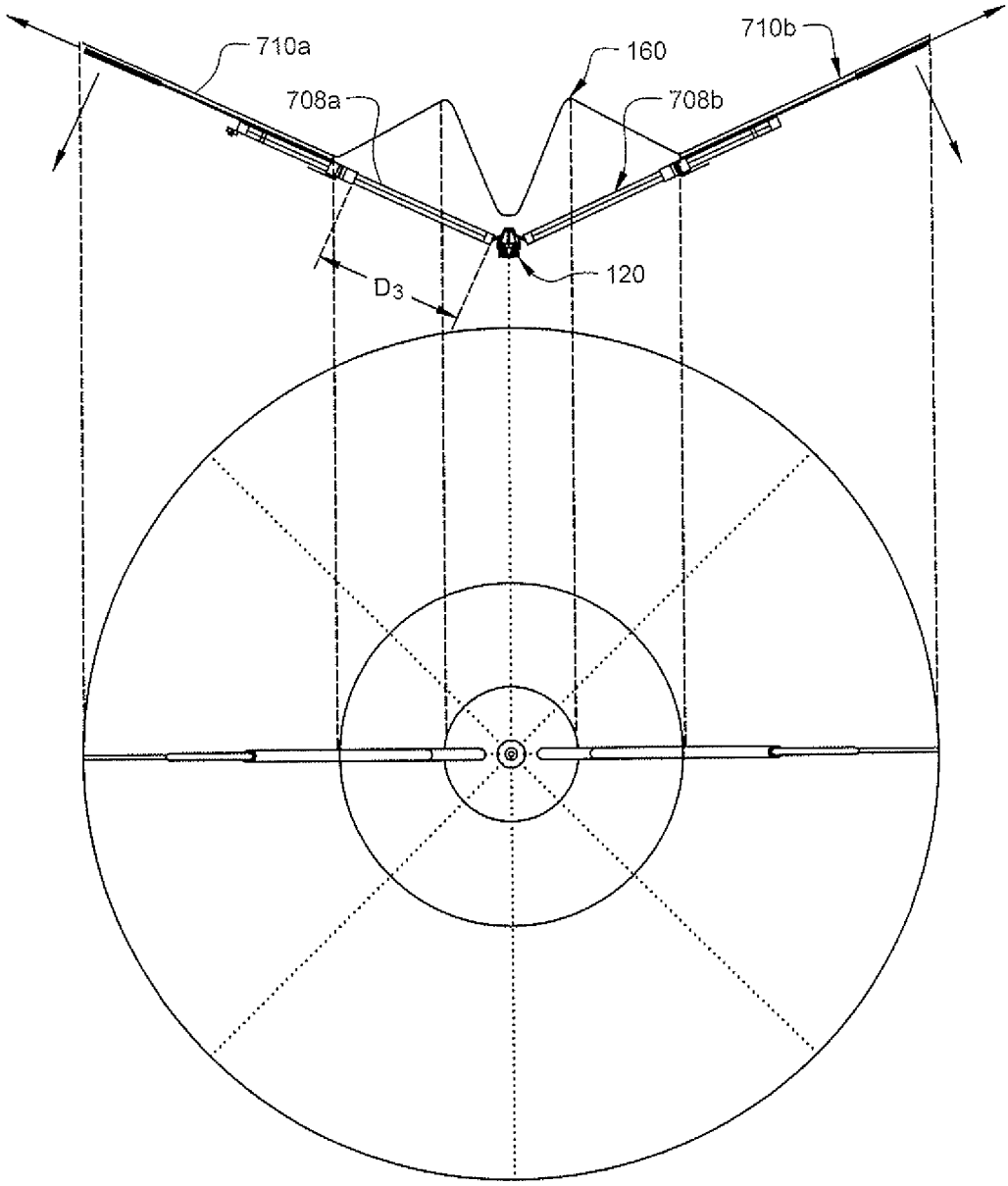
Figure 8D:
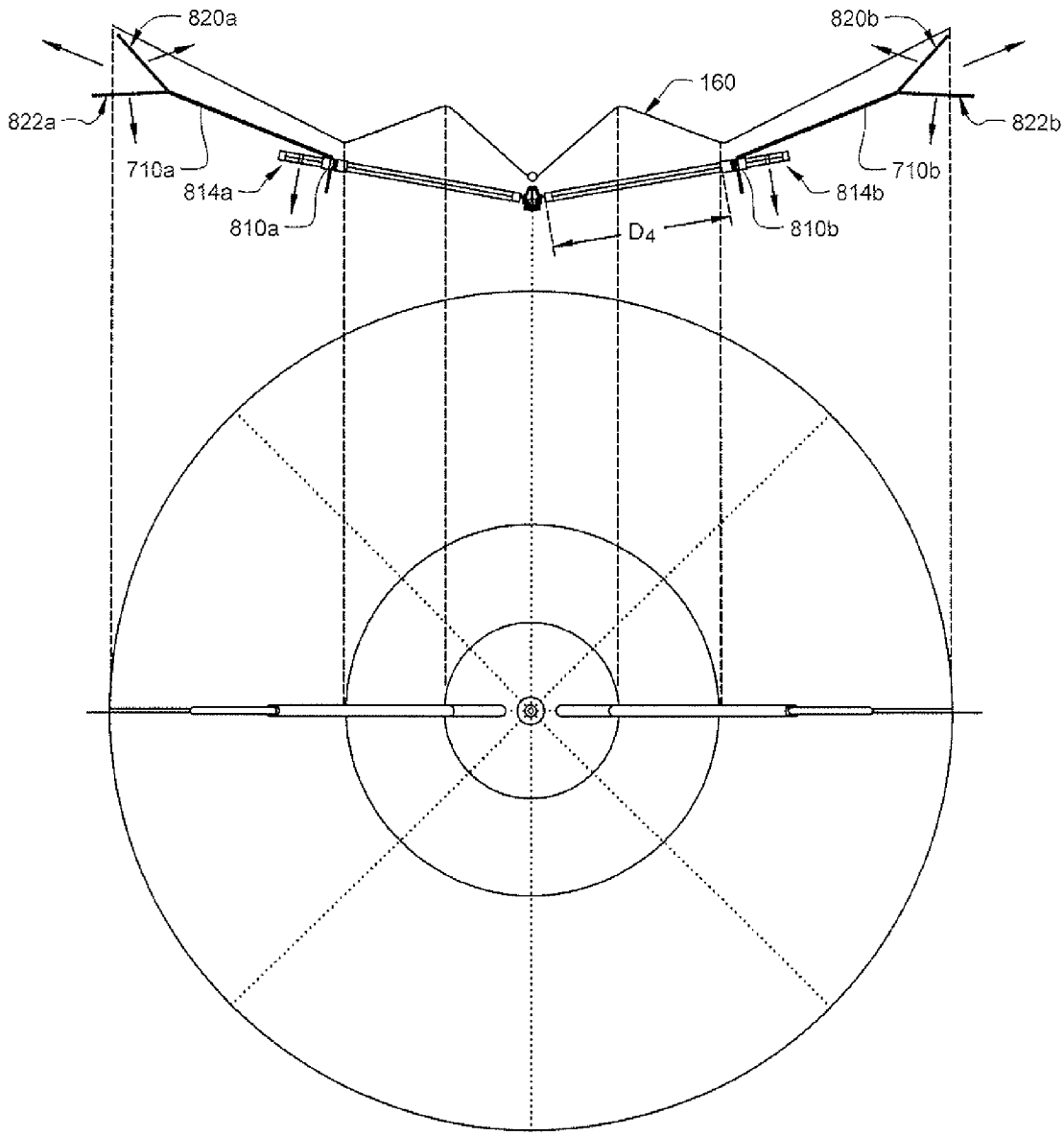
Figure 8E:
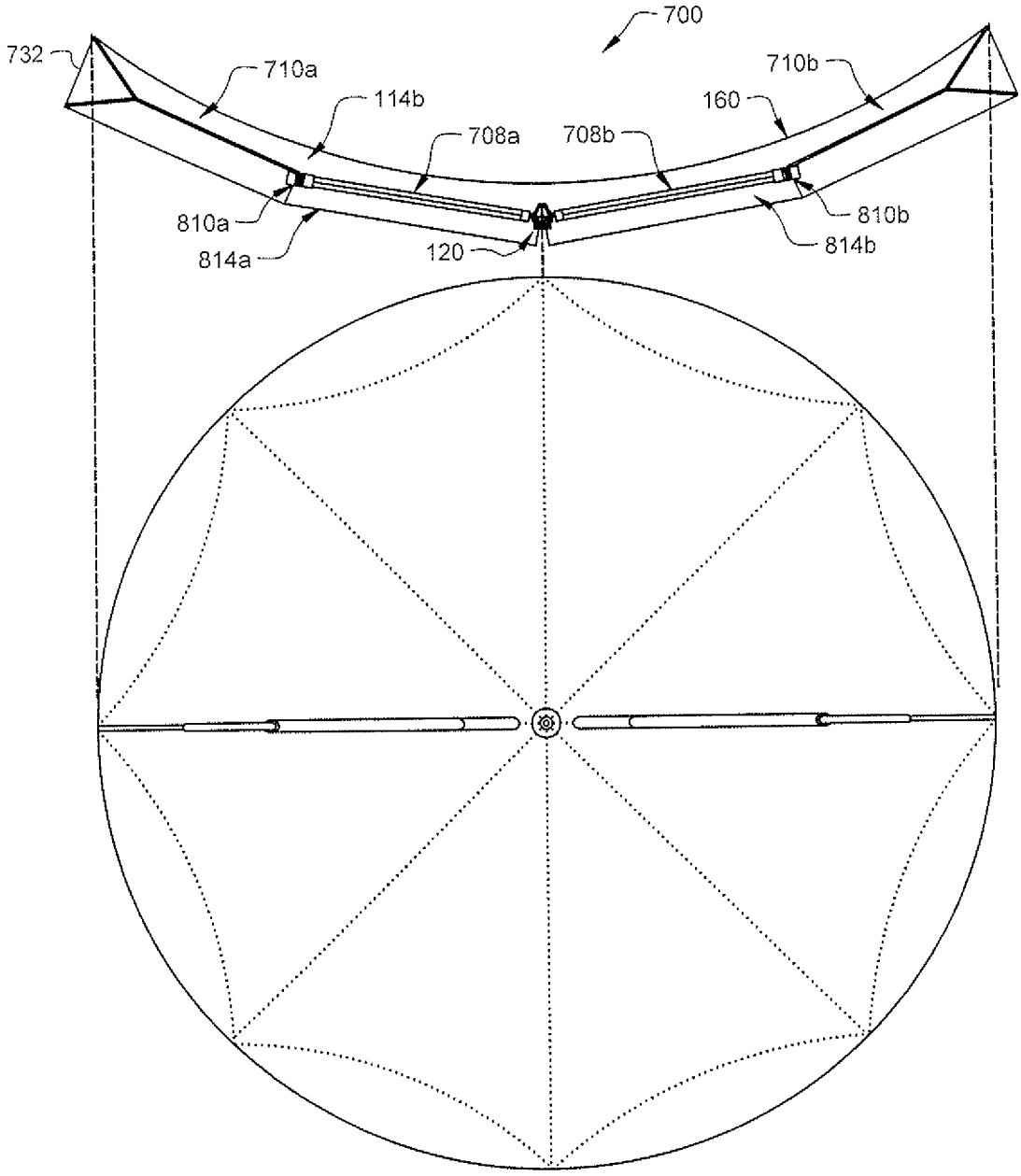

Referring now to FIGS. 8B-8C, each of the reflector ribs 706*a*, 706*e* is shown in various intermediary positions between the stowed position shown in FIG. 8A and the extended position shown in FIG. 8E. In these various intermediary positions, the distal ends 814*a*, 814*b* of the inner ribs 708*a*, 708*b* have moved radially away from each other. Also, the collars 810*a*, 810*b* of the outer ribs 710*a*, 710*b* have moved outward along the inner ribs 708*a*, 708*b* to a distance $D_2$, $D_3$ from the common hub 120. In effect, the antenna reflector surface 122 is partially unfolded as shown in FIGS. 8B-8C.

Referring now to FIG. 8D, the distal ends 814*a*, 814*b* of the inner ribs 708*a*, 708*b* have moved further away from each other. Also, the collars 810*a*, 810*b* of the outer ribs 710*a*, 710*b* have moved a further amount outward along the inner ribs 708*a*, 708*b* to a distance $D_4$ from the common hub 120. Further, the compression members 820*a*, 820*b* of the outer ribs 710*a*, 710*b* have moved radially outward a certain distance with respect to the inner ribs 708*a*, 708*b*. Compression members 822*a*, 822*b* of outer ribs 710*a*, 710*b* have moved radially outward a certain distance with respect to the inner ribs 708*a*, 708*b*. In effect, each of the outer ribs 710*a*, 710*b* has a substantially "Y" shape.

Referring now to FIG. 8E, the extendable rib reflector 700 is in its extended position. In the extended position, the collars 810*a*, 810*b* of the outer ribs 710*a*, 710*b* have moved along the inner ribs 708*a*, 708*b* to the distal ends 814*a*, 814*b* thereof. In effect, inner ribs 708*a*, 708*b*, outer ribs 710*a*, 710*b* and guideline truss structure 732 collectively provide a generally parabolic shaped structure for supporting the antenna reflector surface 122. Consequently, the antenna reflector surface 122 is fully unfolded and at least partially supported by the parabolic shaped structure.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

We claim:

1. A method of deploying an antenna reflector including a plurality of extendable ribs coupled to a centrally located hub, each extendable rib of said plurality of extendable ribs including an inner rib rotatably coupled to said centrally located hub and an outer rib slidingly coupled to said inner rib, said method comprising:

rotating said plurality of extendable ribs from a stowed position in which said plurality of extendable ribs are generally aligned with a central axis of said centrally located hub, to a rotated position in which said plurality of extendable ribs extend in radial directions relative to said central axis;

linearly displacing said outer rib along an elongated length of said inner rib from a proximal position adjacent to said centrally located hub to an extended position distal from said centrally located hub; and supporting a flexible antenna reflector surface on a guideline truss structure that is under tension when said outer rib is in said extended position with said guideline truss structure including a plurality of arch cords extending between distal ends of opposing ones of said outer ribs, and a plurality of standoff cords respectively secured to a plurality of attachment points disposed on each of said outer ribs, said plurality of standoff cords extending between each said outer rib and a respective one of said arch cords at a plurality of intermediate locations along a length of said outer rib between opposing ends thereof; and wherein said outer rib is linearly displaced along said elongated length external of said inner rib.

2. The method according to claim 1, further comprising securing said outer rib in said extended position with a locking mechanism, a mechanical stop or a worm drive.

3. The method according to claim 2, further comprising re-storing said antenna reflector by unsecuring said outer rib, and linearly displacing said outer rib on said inner rib from said extended position to said proximal position adjacent to said centrally located hub.

4. The method according to claim 1, wherein said outer rib is linearly displaced on said inner rib by transforming a rotation induced by at least one motor of said centrally located hub to linear motion.

5. The method according to claim 4, wherein said rotation is transformed to a linear motion using at least one mechanical component selected from the group consisting of a worm gear, a pinion gear, a spur gear, a pulley, a belt drive and a drive shaft.

6. The method according to claim 1, further comprising extending at least one solar panel concurrently with at least one of said rotating and linearly displacing ribs of said plurality of extendable ribs.

7. The method according to claim 1, wherein said linear displacement further comprises transitioning said outer rib from a first position in which said inner rib is substantially contained within said outer rib, to a second position in which said outer rib is substantially extended from within said inner rib.

8. The method according to claim 1, wherein said linear displacing further comprises guiding a collar over an exterior surface of said inner rib.

9. The method according to claim 1, further comprising forming said guideline truss structure by taking up slack in a plurality of guidelines coupled to said centrally located hub and each of said plurality of extendable ribs.

10. The method according to claim 1, further comprising rotating at least one compression member attached to said outer rib from a first position adjacent to said outer rib to a second position extending away from said outer rib.

11. A method of deploying an antenna reflector including a plurality of extendable ribs coupled to a hub, comprising:

rotating a plurality of inner ribs at a proximal end attached to a centrally located hub from a stowed position in which said inner ribs are generally aligned with a central axis of said hub, to a rotated position in which said outer ribs extend in a radial direction relative to said central axis;

supporting a flexible surface using a guideline truss structure attached to a plurality of outer ribs extendable from said inner ribs, said guideline truss structure including a plurality of arch cords extending between distal ends of opposing ones of said outer ribs, and a plurality of standoff cords respectively secured to a plurality of attachment points disposed on each of said outer ribs, said flexible surface supported using said plurality of standoff cords extending between each said outer rib and a respective one of said arch cords at a plurality of intermediate locations along a length of said outer ribs between opposing ends thereof;

tensioning said guideline truss by linearly displacing said plurality of outer ribs respectively along an elongated length of said plurality of inner ribs from a proximal position closer to said centrally located hub, to an extended position distal from said centrally located hub; and wherein said outer ribs are linearly displaced along said elongated lengths external of said inner ribs.

12. An antenna reflector, comprising:

a centrally located hub;

a plurality of inner ribs rotatably secured at a proximal end to said centrally located hub, said plurality of inner ribs rotatable from a stowed position in which said plurality of inner ribs are generally aligned with a central axis of said centrally located hub, to a rotated position in which said plurality of inner ribs extend in a radial direction relative to said central axis;

a plurality of outer ribs extendable from said plurality of inner ribs;

a guideline truss structure configured to support a flexible antenna reflector surface, said guideline truss structure including a plurality of arch cords extending between distal ends of opposing ones of said outer ribs, and a plurality of standoff cords attached to each of said outer ribs, said plurality of standoff cords extending between each said outer rib and a respective one of said arch cords at a plurality of intermediate locations along a length of each said outer rib between opposing ends thereof; and a guide structure included on each of said outer ribs and configured to facilitate linearly displacing each of said plurality of outer ribs respectively along an elongated length of said plurality of inner ribs from a proximal position adjacent to said centrally located hub, to an extended position distal from said centrally located hub; and wherein each said guide structure is arranged to linearly displace said outer rib along said elongated length external of said inner rib.

13. The antenna reflector according to claim 12, further comprising a locking mechanism configured to secure said plurality of outer ribs in said extended position.

14. The antenna reflector according to claim 12, further comprising a deployment device including a motor and at least one mechanical component configured to transform rotation induced by said motor to a linear motion.

15. The antenna reflector according to claim 14, wherein said mechanical component is selected from the group consisting of a worm gear, a pinion gear, a spur gear, a pulley and a drive shaft.

16. The antenna reflector according to claim 12, further comprising at least one solar panel configured to be concurrently extended with said rotating and linearly displacing plurality of outer ribs.

17. The antenna reflector according to claim 12, wherein each inner rib of said plurality of inner ribs is configured to be transitioned from a first position in which said inner rib is substantially contained in a respective outer rib of said plurality of outer ribs, to a second position in which said inner rib is substantially extended from said respective outer rib.

18. The antenna reflector according to claim 12, wherein each of said plurality of outer ribs further comprises a collar configured to be linearly displaced over an exterior surface of a respective inner rib of said plurality of inner ribs.

19. The antenna reflector according to claim 12, further comprising at least one compression member rotatably attached to at least one outer rib of said plurality of outer ribs, said compression member configured to rotate from a first position adjacent to said outer rib to a second position extending away from said outer rib.

* * * * *